US005421556A

United States Patent [19]

Dodge et al.

[11] Patent Number: 5,421,556

[45] Date of Patent: Jun. 6, 1995

[54] MODULAR FENCING COMPONENTS

[75] Inventors: Mark E. Dodge, Ashland; Michael A. Fiume, Tallmadge; Brian K. McGarry, Wadsworth, all of Ohio

[73] Assignee: Associated Materials Inc., Akron, Ohio

[21] Appl. No.: 24,750

[22] Filed: Mar. 2, 1993

[51] Int. Cl.[6] ..... E04H 17/14

[52] U.S. Cl. ..... 256/1; 256/19; 403/326; 403/375; 285/901

[58] Field of Search ..... 256/66, 19, 1; 403/326, 403/308, 300, 375, 385, DIG. 4, DIG. 6; 285/901, 921; 52/301, 300

[56] References Cited

U.S. PATENT DOCUMENTS

| | | | |
|---|---|---|---|
| 350,127 | 10/1886 | Galloway | 256/19 |
| 2,121,379 | 6/1938 | Young | 256/1 X |
| 2,906,507 | 9/1959 | Hodson | 256/1 X |
| 3,902,702 | 9/1975 | Kinnaman | 256/19 |
| 4,722,514 | 2/1988 | Pettit | 256/50 |
| 4,789,138 | 12/1988 | Acton | 256/1 X |
| 4,815,713 | 3/1989 | Schmanski | 256/19 |
| 4,854,548 | 8/1989 | Wylie | 256/65 |
| 4,907,783 | 3/1990 | Fisk et al. | 256/1 X |
| 4,958,807 | 9/1990 | Wylie | 256/65 |
| 5,078,367 | 1/1992 | Simpson et al. | 256/24 |
| 5,215,290 | 6/1993 | Khalessi | 256/19 |

FOREIGN PATENT DOCUMENTS

| | | | |
|---|---|---|---|
| 2529935 | 1/1984 | France | 256/1 |
| 3440160 | 5/1986 | Germany . | |

*Primary Examiner*—Dennis L. Taylor
*Assistant Examiner*—Christopher J. Novosad
*Attorney, Agent, or Firm*—Banner, Birch, McKie & Beckett

[57] ABSTRACT

A plastic fence post and cap are secured to each other by a spring tab arrangement which is completely concealed after assembly. In one embodiment, a bottom section of the cap fits over the end of the post and tabs projecting inwardly from opposed panels of the bottom section extend into holes extending through opposed sides of the post. In a second embodiment, a bottom part of the cap is received within the tubular post and has outwardly extending tabs that spring into recesses provided along inner sidewall surfaces of the post.

7 Claims, 4 Drawing Sheets

MODULAR FENCING COMPONENTS

BACKGROUND OF THE INVENTION

The present invention relates generally to fencing, particularly modular fencing components constructed of molded plastic material. More specifically, the invention relates to capping arrangements for plastic fence posts and the like.

The use of plastics for fencing components is known, e.g., in the agricultural, residential and home improvement industries. Plastics present a desirable alternative to wood as a construction material for fencing. Plastic fencing can take on the natural attractive appearance of wood while exhibiting superior durability. For example, vinyl fencing is highly resistant to the elements and does not require painting. Furthermore, modular plastic fencing components are less expensive to mass produce and easier to assemble than their wood counterparts.

Known plastic fencing constructions are disclosed in Pettit U.S. Pat. No. 4,722,514 and Simpson et al. U.S. Pat. No. 5,078,367. In these constructions, open ended tubular plastic fence posts are covered with decorative and protective molded plastic caps. In Pettit, ribs are formed on the inside surfaces of the bottom portions of the fence caps. The fence caps fit over the posts. The caps, ribs, and posts are dimensioned so that the caps will be held in position with a friction fit. Similarly, Simpson et al. disclose a cap that is friction fit over the end of a fence post. In this design, side walls of the post are friction fit between flanges provided in pairs along the inside perimeter of the fence cap.

The friction fit cap arrangements described above have certain deficiencies. Manufacturing tolerances may result in a friction fit that is too tight or too loose. If the friction fit is too tight, then the caps are difficult or impossible to properly install. If the friction fit is too loose, the cap is not securely held in place and may inadvertently be knocked off. Additionally, repeated removal and replacement of a friction fit cap will, due to wear, lead to loosening of the cap.

An arrangement that partially alleviates the above described problem is shown in German patent No. DE 3440-160-A. Therein, a decorative fence has a cap that is secured to a fence post by a snap tab attached to the cap and extending outwardly into a hole extending through the post sidewall. While this arrangement provides improved retention over the friction fit arrangements described above, the cap is still susceptible to easy removal, e.g., by vandals or thieves, by depression of the exposed tab end. Additionally, the through hole and exposed snap tab therein detract from the appearance of the fence.

It is also known in the art to secure a plastic cap to a plastic fence post using adhesive or known mechanical fasteners such as screws or rivets. These approaches have the obvious disadvantage that a labor intensive operation is required. Furthermore, a good bond by adhesive requires a high degree of surface contact between the mating parts. This may be difficult to consistently attain given the variations in typical plastic molding processes. Additionally, when screws or rivets are applied, care must be exercised to avoid stripping or breaking away the vinyl material, or the means of mechanical bonding will be lost.

SUMMARY OF THE INVENTION

In view of the foregoing, it is a principal object of the present invention to provide an improved arrangement for securing a cap on the end of a tubular fence post or the like.

It is a more specific object of the invention to provide an improved post and mating cap for modular plastic fencing, which may readily be securely snapped together.

It is a further object of the present invention to provide a post and mating cap assembly which conceals the means of attachment.

These and other objects are achieved by the present invention which, in one aspect, provides a modular post and cap assembly comprising a tubular post having a post sidewall extending to a first end and a cap attachable to the first end. The cap has an upper section for covering the first end and a bottom section comprising a panel for overlapping the post sidewall. A spring tab arrangement is provided for attaching the cap to the tubular post. The spring tab arrangement comprises a spring tab on one of the panel and post sidewall, and a cavity formed on the other of the panel and post sidewall for receiving the spring tab. The spring tab arrangement is located and configured such that during assembly of the cap onto the post, the spring tab is elastically displaced in a direction away from the cavity, then allowed to spring into the cavity. The spring tab arrangement is completely concealed by at least one of the panel and post sidewall when the cap and post are assembled.

In another aspect, the invention provides a structural assembly for modular plastic fencing, comprising a molded plastic tube having a sidewall extending to a first end and a pair of holes formed in opposing sides of the sidewall proximal the first end. A molded plastic cap is attachable to the first end, and has an upper section for covering the first end and a bottom section for extending over the post sidewall. The bottom section includes a pair of spring tabs protruding inwardly from inner surfaces of opposed resiliently deformable wall panels of the bottom section. During assembly of the cap onto the plastic tube, the wall panels and spring tabs are elastically displaced outwardly, then the spring tabs are allowed to spring into the pair of holes to secure the cap to the post.

In yet another aspect, the invention provides a structural assembly for modular plastic fencing comprising a molded plastic tube having a sidewall extending to a first end, and a pair of blind recesses formed in opposing inner sides of the sidewall proximal the first end. A molded plastic cap is attachable to the first end, and has an upper section for covering the first end and a bottom section for insertion into the post. The bottom section includes a pair of opposed resiliently deformable flanges and a pair of spring tabs protruding outwardly from outer surfaces of the flanges. During insertion of the bottom section of the cap into the plastic tube, the flanges and spring tabs are elastically displaced inwardly, then the spring tabs are allowed to spring into the recesses to secure the cap to the post.

DETAILED DESCRIPTION OF THE PREFERRED EMBODIMENTS

Figure 1:
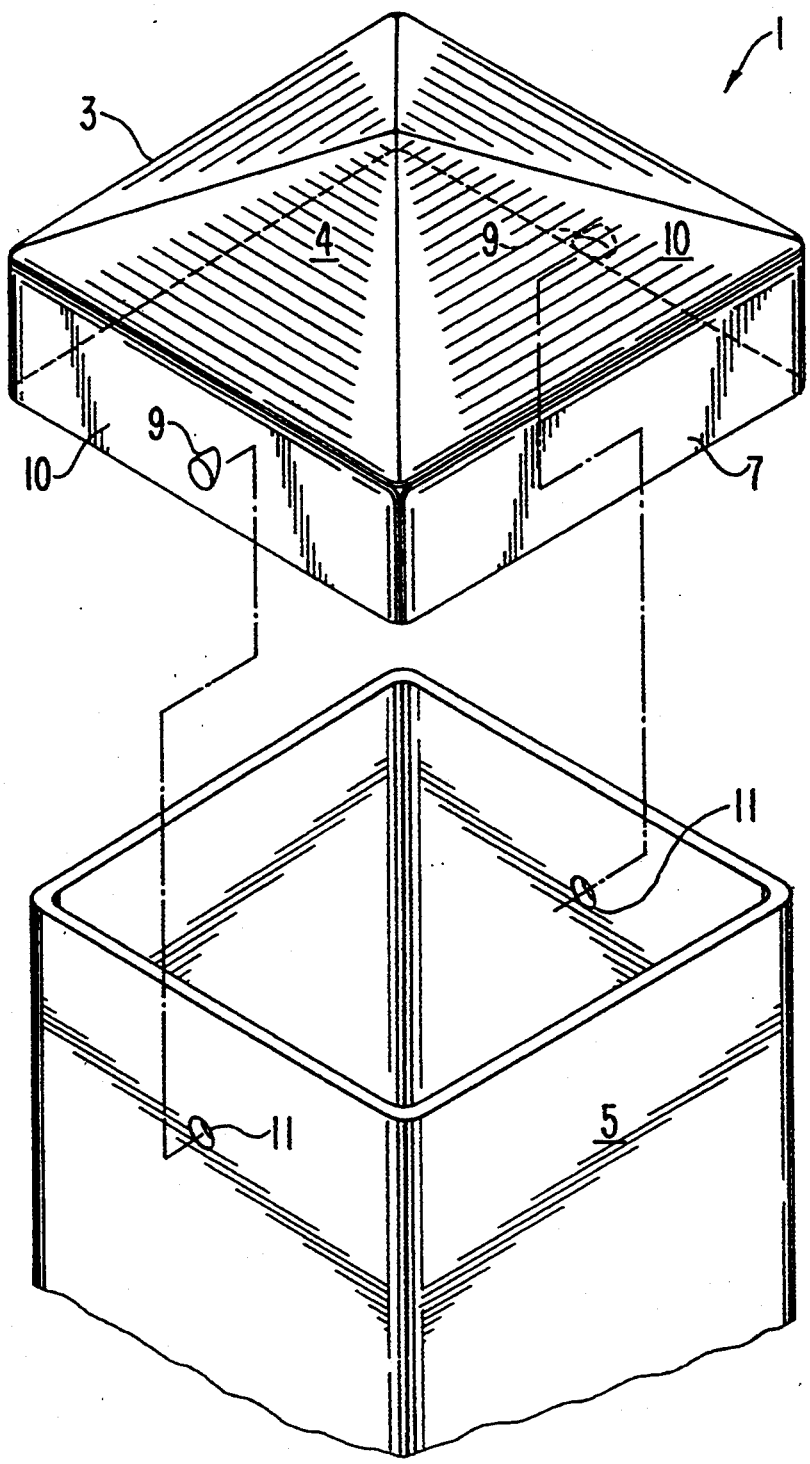
FIG. 1 is a perspective assembly view of a first fence post and cap embodiment of the present invention.
Figure 2:
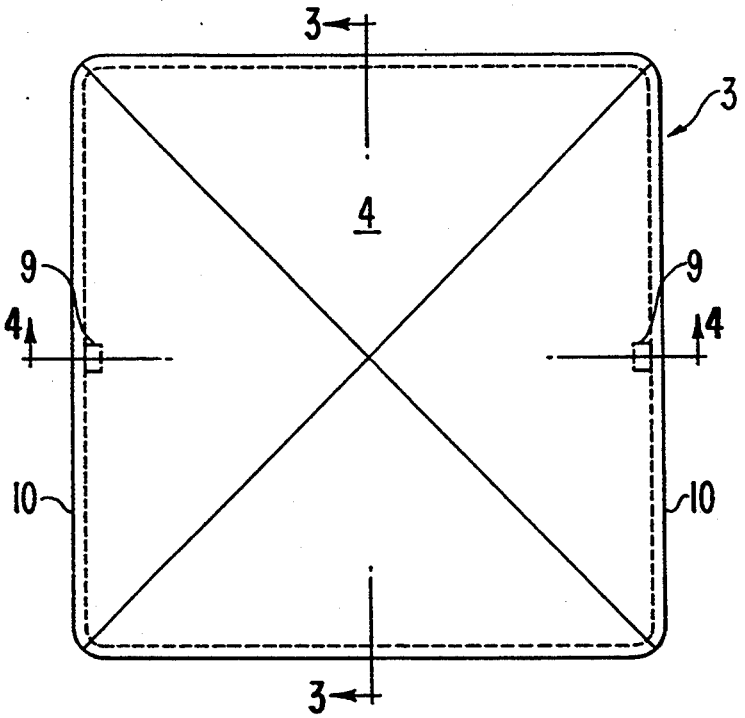
FIG. 2 is a top plan view of the cap illustrated in FIG. 1.
Figure 3:
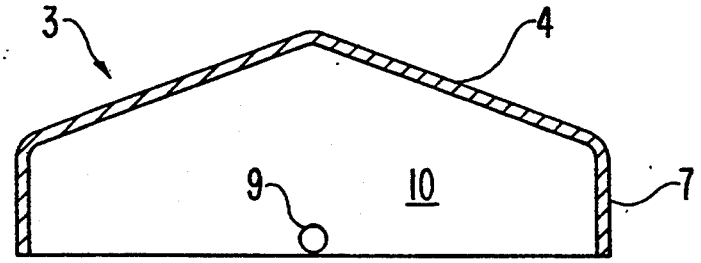
FIG. 3 is a cross-sectional view taken on line 3—3 in FIG. 2.
Figure 4:
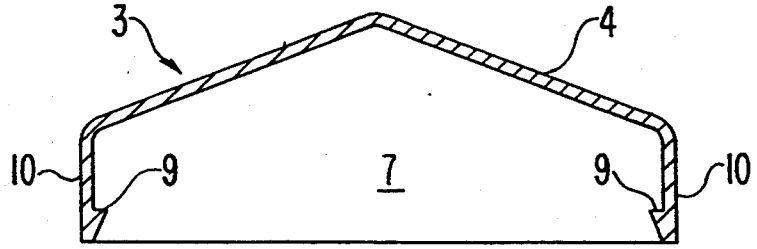
FIG. 4 is a cross-sectional view taken on line 4—4 in FIG. 2.
Figure 5:
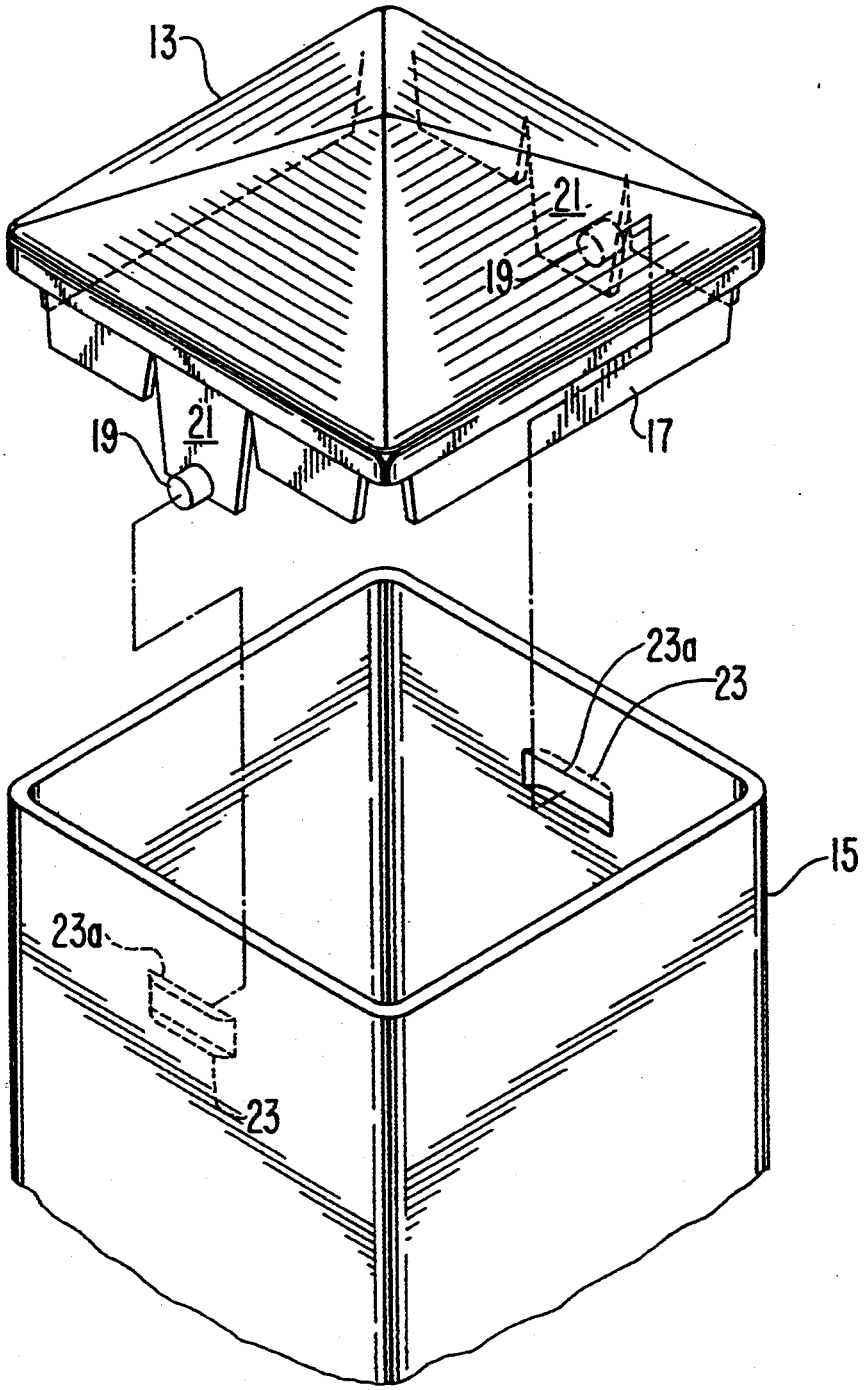
FIG. 5 is a perspective assembly view of a second fence post and cap embodiment of the present invention.
Figure 6:
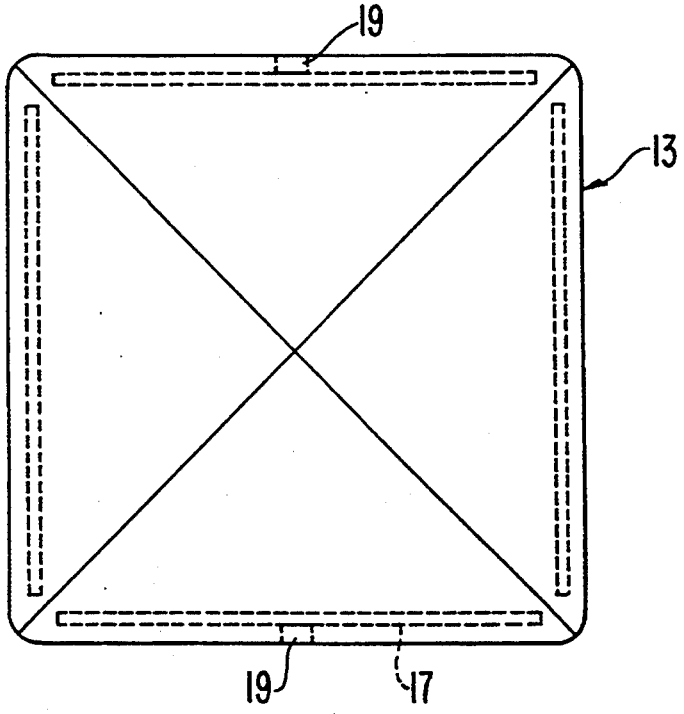
FIG. 6 is a top plan view of the cap illustrated in FIG. 5.
Figure 7:
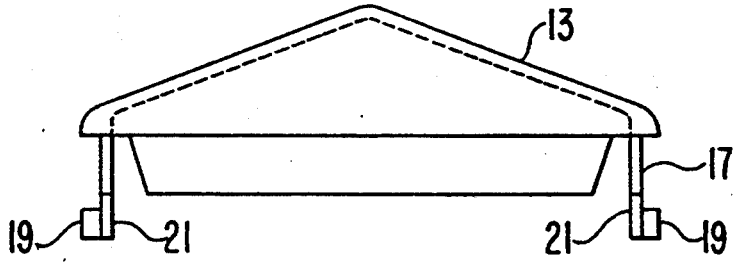
FIG. 7 is a side elevational view of the cap illustrated in FIG. 6.
Figure 8:
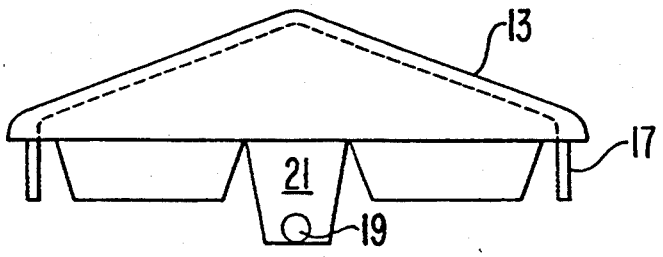
FIG. 8 is a front elevational view of the cap illustrated in FIG. 6.

Designated generally by 1 in FIG. 1 is a first preferred fence post and cap assembly of the present invention. The assembly comprises a molded plastic cap 3 and a molded plastic post 5. A preferred plastics material for each of these parts is polyvinylchloride (PVC). Other suitable plastic and non-plastic materials may be utilized as well. Typically, the assembly would be produced, sold and assembled as part of a modular plastic fencing kit, along with other like fencing components such as pickets and rails.

As seen in FIGS. 1–4, cap 3 has a pyramid shaped decorative top section 4 and a bottom section 7 comprising a continuous vertical sidewall extending downwardly from the top section on each peripheral side. Two robs 9 are formed on inside surfaces of opposing panels 10 of the vertical sidewall, and project inwardly towards each other. Post 5 has a square tubular shape corresponding to the square shape of cap bottom section 7. Post 5 may be hollow or filled with reinforcing material, e.g., foamed plastic. Bottom section 7 fits over the end of post 5 so that tabs 9 project into the cavities formed by holes 11 extending through opposed sides of the post. As cap 3 is slid onto post 5, the contact of the ends of robs 9 with the opposed post sides causes corresponding panels 10 to deflect outwardly. Tabs 9 spring into holes 11 under the spring force of deflected panels 10 when tabs 9 are positioned over holes 11. In this manner, cap 3 is securely held on post 5, with the securing means (tabs 9 and holes 11) completely concealed.

Tabs 9 and holes 11 are preferably complimentary shaped as cylinders, although a variety of other shapes may be used as well. Preferably, the ends of tabs 9 are beveled to provide cam surfaces for facilitating the sliding placement of cap 3 over post 5.

Cap 3 may be formed by injection molding, with tabs 9 integrally molded therewith. Post 5 is preferably extrusion molded. Holes 11 are conveniently drilled following the extrusion operation.

While cap 3 and post 5 are shown with a square cross-sectional shape, and the top section of cap 3 has a pyramid shape, it will be understood that other shapes may be utilized depending upon aesthetic preferences. For example, the top section of cap 3 could be configured as a sphere, with bottom section 7 and post 5 having cylindrical shapes.

Since tabs 9 and holes 11 are completely concealed and protected by sidewalls 7, aesthetics are improved and the two parts are less likely to inadvertently become detached. Since there is no immediately apparent means for disconnecting the parts, theft and vandalism are reduced. On the otherhand, should it become necessary to disassemble the cap and post, this can be done in a simple non-destructive manner by deflecting outwardly one or both of opposing panels 10 to allow removal of tabs 9 from holes 11.

A second embodiment of the invention is now described with reference to FIGS. 5–8.

The second embodiment is similar to the first in that a plastic cap 13 is secured to a complimentary shaped plastic tubular post 15 by a spring tab arrangement which is entirely concealed once the assembly is complete. Just as in the first embodiment, the spring tab arrangement comprises a spring tab on the cap and a cavity for receiving the spring tab on the post. In this embodiment, however, a bottom cap section 17 is formed by a plurality of discrete downwardly projecting flanges positioned slightly inwardly from the peripheral edge of cap 13, so as to fit snugly within the sidewalls of post 15. Two tabs 19 are formed on outside surfaces of opposite flanges or panels 21. Flanges 21 act as resilient spring arms allowing tabs 19 to deflect inwardly as bottom section 17 of cap 13 is inserted into post 15. Flanges 21 cause tabs 19 to spring back into cavity forming recesses 23 provided along the inner surfaces of opposed post sidewalls. This occurs as soon as cap 13 is properly positioned on post 15.

Recesses 23 form lips **23*a* that act as catches for tabs 19 within tubular post 15. Recesses 23 are blind, i.e., they do not extend to the outside of post 15. Accordingly, the means of attachment of cap 13 to post 15 are completely concealed and the same advantages of the first embodiment are obtained. Recesses 23 may be integrally formed with post 15 during the molding process, or may be machined into the inner post surfaces following the molding process. Recesses 23 are shown as negative depressions in the otherwise smooth inner surfaces of the post sidewall. Alternatively, inwardly directed protrusions might be utilized to create a recess or lip that acts as a catch for tabs 19. Such a protrusion could be formed integral with or separate from the molded post. This arrangement is less desirable than that illustrated in that with the former, cam surfaces would be necessary for guiding tabs 19 over the protrusions and into the recesses. Also, a protrusion would not be as easy to form as recess 23**.

In both the first and second embodiments, the male locking component, i.e., the spring tab, is provided on the cap and the female locking component (a cavity formed by a hole or recess) is provided on the post. It can readily be appreciated that this arrangement could be reversed with substantially equivalent operational results. The illustrated arrangement is preferred from a manufacturing standpoint because the post is preferably extruded, and it is easier to machine holes or recesses into the extruded post than it is to add protrusions tabs thereto. It is a simple matter to provide tabs integral with the cap using an injection molding process.

The invention has been described above in terms of preferred embodiments thereof. It will be understood that the invention is not limited to these particular embodiments. Numerous other embodiments and modifications within the scope and spirit of the invention will, given the benefit of this disclosure, occur to those having ordinary skill in the art.

We claim:

1. A modular post and cap assembly, comprising:

an elongated tubular post having a post sidewall of generally uniform wall thickness extending longitudinally to a first end;

an end cap attachable to said first end, said cap having an upper section for covering said first end and a bottom section comprising a cap sidewall that extends about the periphery of said upper section and fits over said first end of the post in overlapping relation therewith; and a spring tab arrangement for attaching said cap to said tubular post, said spring tab arrangement comprising a spring tab provided on an inside surface of said cap sidewall, and a cavity provided on an outside surface of the post side wall, for mating with said spring tab;

wherein:

during assembly of the cap onto said post, said spring tab is elastically displaceable in a direction away from said cavity then able to spring into said cavity; and neither of said spring tab or said cavity extends beyond a lower edge of said cap sidewall when said post and cap are assembled, wherein said spring tab arrangement is completely concealed by said cap sidewall.

2. A post and cap assembly according to claim 1, wherein said cavity is formed by a hole passing completely through said post sidewall, and said cap sidewall extends continuously about a peripheral edge of said upper section.

3. A post and cap assembly according to claim 1, wherein said sidewall is resiliently deformable to provide a spring action to said spring tab.

4. A post and cap assembly according to claim 3, wherein said spring tab has a beveled end providing a cam surface for facilitating a sliding action of the cap onto said post during assembly.

5. A post and cap assembly according to claim 3, wherein said cap sidewall that extends continuously about the entire periphery of said upper section and a pair of said spring tabs provided on two opposite inside surfaces of said cap sidewall for mating with a pair of cavities provided on opposite outside surfaces of said post sidewall.

6. A post and cap assembly according to claim 1, wherein said cap and post each have a substantially rectangular cross-section, and said upper section of the cap has a pyramid shape.

7. A post and cap assembly according to claim 1, wherein said tubular post and end cap are each constructed of molded plastic material.

* * * * *